United States Patent [19]

Davies

[11] Patent Number: 4,498,699

[45] Date of Patent: Feb. 12, 1985

[54] LIFTING CLAMP LOCKING MECHANISM WITH PUSH BUTTON RELEASE HANDLE

[75] Inventor: William Davies, Jacksonville, Fla.

[73] Assignee: J. C. Renfroe and Sons, Inc., Jacksonville, Fla.

[21] Appl. No.: 437,799

[22] Filed: Oct. 29, 1982

[51] Int. Cl.[3] ..... B66C 1/48

[52] U.S. Cl. ..... 294/101

[58] Field of Search ..... 294/101, 116, 102 R, 294/103 R, 104, 106, 114, 113, DIG. 1; 24/241, 248

[56] References Cited

U.S. PATENT DOCUMENTS

| | | | |
|---|---|---|---|
| 1,351,530 | 8/1920 | Meals | 294/101 |
| 3,370,881 | 2/1968 | Renfroe | 294/101 |
| 3,441,308 | 4/1969 | Gardner | 294/101 |
| 3,773,377 | 11/1973 | Kopp | 294/101 |
| 3,843,186 | 10/1974 | Van de Wetering | 294/101 |
| 3,857,600 | 12/1974 | Hasegawa | 294/101 |
| 4,162,804 | 7/1979 | Davies | 294/101 |

*Primary Examiner*—James B. Marbert

*Attorney, Agent, or Firm*—Banner, Birch, McKie & Beckett

[57] ABSTRACT

A lifting clamp for articles such as steel plates has a clamp body defining a slot to receive the article to be lifted with opposed jaws mounted on opposite sides of the slot, one jaw being mounted for opening and closing movement relative to the other jaw, a shackle mounted for guided movement in the clamp body and adapted for connection to a lifting force, linkage connecting the shackle to the movable jaw and a shiftable locking mechanism engagable with the assembly of the movable jaw and linkage to lock the jaws in either their open or closed positions. The locking mechanism has associated therewith a spring biased locking pin carried by the clamp body for holding the locking mechanism in the closed jaw position and a handle operable from the clamp body exterior to shift such mechanism, such handle carrying a manually engagable push button disposed to be engagable with the locking pin to release the locking mechanism from the closed jaw position.

6 Claims, 2 Drawing Figures

LIFTING CLAMP LOCKING MECHANISM WITH PUSH BUTTON RELEASE HANDLE

BACKGROUND OF THE INVENTION

The field of the invention relates to clamps for lifting articles such as steel plates and particularly to such lifting clamps having a locking mechanism to retain the clamp jaws in either open or closed positions.

One example in the prior art of this type lifting clamp is disclosed in Renfroe U.S. Pat. No. 2,654,630 issued Oct. 6, 1953. The clamp itions by one of the jaws being movable and operated by a shackle connected to this movable jaw by a force multiplying in linkage.

In prior art constructions the lifting clamp body is formed by spaced side plates with a pivotally mounted locking plate between these side plates that is operated by a handle located outside the side plates. A heavy tension spring connects the locking plate to the linkage which extends between the shackle and the movable jaw. Rotation of the handle to the closed position for the jaws causes the tension spring to exert a heavy closing force on the movable jaw. This handle rotation also causes the spring to move over center to urge the pivot pin, connecting the locking plate to the handle toward a position relative to its normal disposition that creates resistance to operation of the locking handle.

Another type lifting clamp found in the field of the instant invention is exemplified by Davies U.S. Pat. No. 4,162,804 issued July 31, 1979. The lifting clamp of this patent possesses the generally described features mentioned above but provides an added safety advantage. In the abovedescribed lifting clamp there is the danger that in use the operating handle may strike an object while the steel plate article is being lifted. This could result in release of the handle to its open position, thereby creating the danger that the steel plate may become released from the clamp during the intended lifting operation. In solving this problem the Davies U.S. Pat. No. 4,162,804 incorporates an auxiliary spring biased locking pin which is engageable with the locking handle to effectively latch the handle against inadvertent movement from its position where the lifting clamp jaws are urged toward their closed position.

However, in the above prior art constructions, operating conditions or use environments may be encountered in which operation or release of the auxiliary lock means, like that disclosed in the Davies patent, may become difficult or at least awkward to achieve. With the structure of the auxiliary lock of the Davies type lifting clamp the locking pin must be depressed before the lock handle can be moved to its position for opening the lifting clamp jaws. This locking pin in its operative position while holding or latching the locking handle is nested in a notch of the handle. Whereas this nesting of the pin in the handle notch offers advantages in protecting the pin from accidental or inadvertant depression or dislodgement as would release the handle, its location nested in the handle notch can create difficulty in depressing the locking pin. This difficultly can be accentuated in smaller size lifting clamps and when the lifting clamp is in a location or use environment where the access area to the locking pin is restricted.

SUMMARY OF THE INVENTION

Generally, the invention relates to a lifting clamp comprising a clamp body having spaced side plates defining a slot to receive the article to be lifted. A pair of opposed jaws are mounted on opposite sides of the slot with one of these jaws being pivotally mounted for opening and closing movements relative to the other jaw. A shackle is mounted for guided movement in the clamp body, the shackle being adapted for connection to a lifting force. Link means connects the shackle to the pivotally mounted jaw to close the jaws when a lifting force is applied to the shackle. A shiftable locking mechanism engages with the assembly consisting of the movable jaw and the link means, such mechanism acting to lock the jaws in either open or closed positions.

The shiftable locking mechanism includes a pivotally mounted handle that is operable from the exterior of the clamp body to shift the mechanism from the open jaw position to the closed jaw position. The clamp body has lock means thereon engagable with this handle to latch the handle and hold the shiftable locking mechanism in its closed jaw position. The lifting clamp of the invention is provided with a manually engagable push button that is carried by the handle and disposed to be engagable with the lock means to release the locking mechanism from its closed jaw position.

It is a principal object of the invention to provide an improved lifting clamp with a shiftable locking mechanism which incorporates a lock pin and manually engagable means carried by the locking handle to effectively latch the handle of the locking mechanism against inadvertent release while enabling safe and convenient release of the handle when desired.

Another object of this invention is to provide a lock means for the handle of a shiftable locking mechanism on a lifting clamp incorporating a push button recessed in the handle to obviate its accidental depression while being readily available for manual engagement to release the lock means.

Another object of this invention is to provide a manually engagable push button essentially flush with the handle surface of a shiftable locking mechanism for a lifting clamp in accordance with the above objects which may easily be manually depressed to unlatch an auxiliary lock means that is provided to latch the handle of the lifting clamp locking mechanism.

Other advantages of this invention will become apparent from the following disclosure taken in connection with the accompanying drawing wherein a preferred construction of the invention is set forth by way of example.

DESCRIPTION OF A PREFERRED EMBODIMENT

Figure 1:
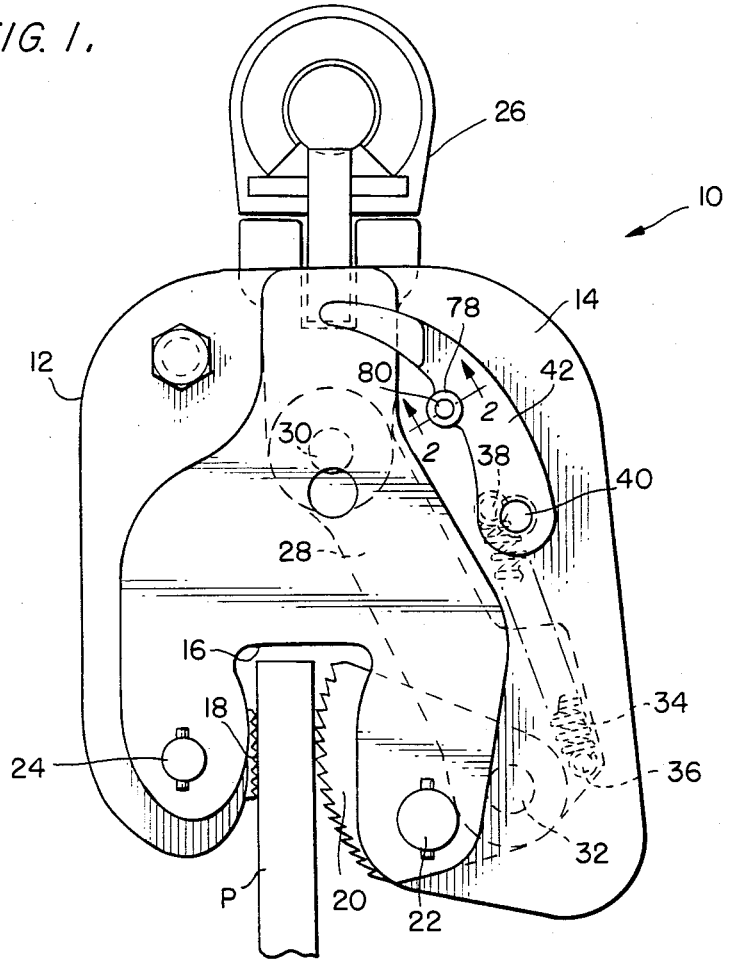
FIG. 1 is side elevational view of the lifting clamp side carrying the manually operated handle for the shiftable locking mechanism showing the handle in its latched closed jaw position.

As shown on FIG. 1, the clamp 10 has its shiftable locking mechanism latched in the position where the jaws of the clamp are urged to hold an article being lifting such as plate P. When this mechanism is unlatched and the handle of the clamp moved to shift the mechanism to the open jaw position the two jaws of the clamp are moved apart to be ready to receive an article to be lifted.

The clamp 10 has a clamp body 12 provided by spaced side plates 14. These side plates define a slot 16 to receive the article that is to be lifted such as plate P. A pair of opposed jaws 18 and 20 are mounted on opposite sides of the slot 16 with jaw 20 being pivotally mounted on pin 22 to permit opening and closing movements of jaw 20 relative to jaw 18. Jaw 18 may be suitable mounted on pin 24 through body 12 between side plates 14 for guided sliding movement relative to the clamp body. The inner end of shackle 26 is pivotally connected to a link 28 by pin 30 with the opposite end of link 28 being pivotally connected to the clamp jaw 20 by pin 32. Thus, when a lifting force is applied to shackle 26 as by means of a conventional lifting hook at the end of an hoisting cable being engaged with the lift opening of shackle 26 this applied force will act through link 26 to close the jaws 18 and 20 thereby tending to grip an article such as plate P disposed between such jaws.

Clamp body 12 of lifting clamp 10 carries a shiftable locking mechanism which is engagable with the assembly that consists of link 28 and the pivotally mounted jaw 20. In the particular form of structure shown on FIG. 1 this locking mechanism is connected with the link 28 of this assembly.

The locking mechanism comprises a spring 34 located between the spaced side plates 14 having one end connected by a pin 31 to link 28 adjacent the pin 32 that connects such link to the pivotally mounted jaw 20. The opposite end of spring 34 is connected by pin 38, also disposed between the side plates 14, to move with shaft 40, pin 38 being mounted eccentrically relative to the axis of rotating shaft 40. Shaft 40 is pivotally supported on the side plates 14 of clamp body 12. One end of shaft 40 extends through a side plate 14 with an operating handle 42 is fixedly secure to shaft 40 as shown on FIG. 1.

The above structure for the lifting clamp 10 is only briefly described and somewhat diagrammatically shown on FIG. 1 since basically this lifting clamp structure is known in the prior art such as exemplified by the above identified U.S. Pat. Nos. 2,654,630 and 4,162,804. In the structures of these patents and structure for the lifting clamp 10 of FIG. 1 described above, the action of the tension spring in the shiftable locking mechanism of the lifting clamp is generally comparable.

Thus, referring to FIG. 1, the spring 34 is tensioned by swinging handle 42 to rotate shaft 40 which swings pin 38 eccentrically above the axis of shaft 40 in a counterclockwise direction to the position shown on FIG. 1. In this position the tension of spring 34 urges the jaw 20 toward its closed position relative to opposed jaw 18. Likewise the tension on spring 34 is released by reverse or clockwise swinging of handle 42 to rotate shaft 40 whereby the jaws 18 and 20 are freed to move to their open position absent the application of lifting force to the lift opening of shackle 26.

Further details as to the operating characteristics of this type lifting clamp and appropriate structural details which may be employed in its construction can be found by reference to prior art such the two above-identified patents. It is not deemed necessary to specifically illustrate or describe these details herein.

Figure 2:
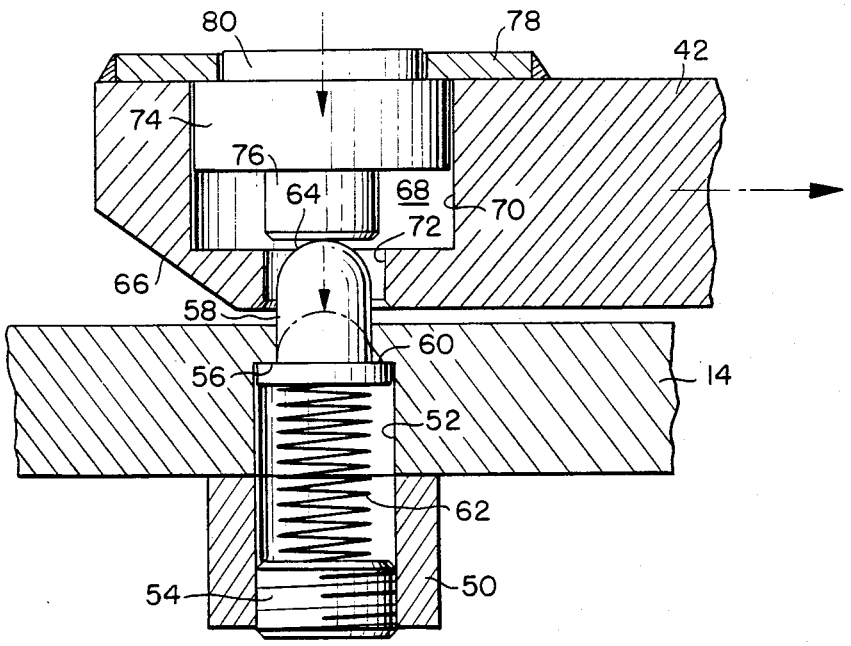
FIG. 2 is a sectional view taken on line 2—2 of FIG. 1.

Reference may now be made to FIG. 2 on the drawing which illustrates the details of the lock means mounted on the clamp body which functions to latch the handle 42 in position to hold the shiftable locking mechanism in its closed jaw position and the manually engagable means carried by handle 42 which is activated to release handle 42 from this latched position.

The lock means mounted on the clamp body to be engagable with handle 42 is provided by a sleeve 50 suitably secured on the inside wall of one of the side plates 14 that make up lifting clamp body 12. This side plate 14 has a hole 52 aligned with the interior of sleeve 50. A threaded plug 54 is threaded into the end of sleeve 50 with plug 54 being suitably provided with a screwdriver slot (not shown) whereby the location of plug 54 relative to sleeve 50 may be adjusted by being threaded into or out of sleeve 50. The other end of hole 52 in side plate 14 has a reduced diameter portion providing a shoulder 56 intermediate the length of hole 52. A lock pin 58 is slidably received in the pocket formed by sleeve 50 and hole 52 with such pin having an annular flange 60 which engages with the shoulder 56 to limit outward movement of lock pin 58 relative to hole 52.

A compression spring 62 is disposed within hole 52 between threaded plug 54 and lock pin 58 such spring acting to bias pin 58 outwardly to normally retain flange 60 of pin 58 engaged with shoulder 56 of hole 52. The location of threaded plug 54 may be adjusted by threading it into or out of sleeve 50 so as to more or less compress spring 62 and thereby apply the desired force in urging lock pin 58 outwardly relative to the surface of side plate 14.

The outer end of lock pin 58 may have a hemispherical configuration 64. The hemispherical configuration 64 on locking pin 58 is advantageous to cooperate with an inclined camming surface 66 provided on handle 42. In this regard it will be appreciated that as handle 42 is moved counterclockwise into its final latched position as shown on the drawing, the inclined cam surface 66 will engage with the hemispherical configuration 64 on pin 58 acting to depress the pin 58 into hole 52 against the biasing force of spring 62 during the interval that handle 42 is moving into its final position. When the handle reaches this final position as shown in FIG. 2, the locking pin 58 under the biasing force of spring 62 will snap into the stepped bore provided in handle 42 as described hereinafter.

Handle 42 has an aperture in the form of a stepped bore 68 consisting of a large diameter portion 70 and a reduced diameter portion 72. The portion 72 has a diameter slightly larger than the diameter of lock pin 58. The large diameter portion 70 of the cylindrically stepped bore 68 receives a push button 74. Push-button 74 is cylindrically stepped with a large diameter segment slidably received within the large diameter portion 70 of the stepped bore and smaller diameter segment 76 having a diameter comparable to the reduced diameter portion 72 of the stepped bore 68.

Push button 74 is retained within the stepped bore 68 by an annular ring 78. Ring 78 may be appropriately secured as by welding to the outer surface of handle 42. The manually engagable push button 74 has a reduced diameter segment 80 projecting up through the retainer ring 78 so that the exposed surface thereof lies essentially flush with the surface of retainer ring 78.

It will be appreciated that when the handle 42 has been shifted into its position as illustrated on the drawing, the lock pin 58 will be pressed into the stepped bore 68 by the biasing effect of spring 62. This will displace the push button 74 into its outermost position as shown in FIG. 2 relative to this bore 68, exposing the outer end segment 80 of the push button generally flush with the retainer ring 78. In this condition the handle 42 is positively latched against inadvertent displacement.

To unlatch the handle 42, the push button 74 is manually depressed by pressing against push button segment 80 which consequently depresses the lockor released so that it may be swung clockwise as shown in FIG. 1 to release the lifting clamp locking mechanism.

As has been mentioned hereinbefore, the provision of the push button 74 makes it particularly convenient for the lifting clamp user to operate the release push button. This convenience can be particularly important on smaller size lifting clamps when the access area to the push button for its release may be unduly restricted.

A preferred embodiment of the invention has been specifically illustrated and described above. It will be understood however that various modifications may be made by persons skilled in the art without departing from the scope of the invention which is defined solely by the appended claims.

I claim:

1. A lifting clamp for articles such as steel plates comprising:

a clamp body having spaced side plates defining a slot to receive the article to be lifted;

a pair of opposed jaws mounted on opposite sides of said slot with one of said jaws being pivotally mounted for opening and closing movements relative to the other jaw;

a shackle mounted for guided movement in said clamp body and adapted for connection to a lifting force;

link means connecting said shackle to said pivotally mounted jaw to close said jaws when a lifting force is applied to said shackle, said link means and said pivotally mounted jaw forming an assembly;

shiftable locking mechanism engagable with said assembly to lock said jaws in respective open or closed positions including a pivotally mounted handle operable from the exterior of the clamp body to shift said mechanism from open jaw position to closed jaw position;

lock means independent of said locking mechanism mounted on said clamp body engagable with said handle to latch said handle to hold said mechanism in its closed jaw position; and manually engagable means movably mounted on said handle to be engagable with said lock means to release said handle from its latched position.

2. A lifting clamp as recited in claim 1 wherein said shiftable locking mechanism comprises a spring between said side plates connected to said assembly, said spring being tensioned by rotation of said handle to urge said jaws toward said closed position and the tension released by reverse rotation of said handle to free said jaws to move to said open position.

3. A lifting clamp as recited in claim 1 wherein said lock means is spring biased to be releasable to free said handle from said latched position.

4. A lifting clamp as recited in claim 1 wherein said lock means comprises a pin reciprocally mounted in a pocket within said clamp body, said pin being spring biased to extend outwardly of said body for engagement with said handle in latching said handle.

5. A lifting clamp as recited in any one of claims 1, 2, 3 or 4 wherein said manually engagable means comprises an aperture in said handle disposed to be aligned with said lock means when said handle is in its latched position, and a push botton slidably retained in said aperture to be generally flush with the handle surface.

6. A lifting clamp as recited in claim 5 wherein said aperture is a stepped bore, said push button is cylindrically stepped to cooperate with said bore, and retainer means is provided to retain said button in said bore.

* * * * *